US005193290A

United States Patent [19]

Tolson

[11] Patent Number: 5,193,290

[45] Date of Patent: Mar. 16, 1993

[54] APPARATUS AND METHOD FOR SEQUENTIAL SHRINKING OF PACKAGING FILM

[75] Inventor: Sidney S. Tolson, Scotland Neck, N.C.

[73] Assignees: Ossid Corporation, Rocky Mount, N.C.; Ibaraki Seiki Machinery Company, Ltd., Osaka, Japan

[21] Appl. No.: 944,340

[22] Filed: Sep. 14, 1992

[51] Int. Cl.[5] ..... F26B 7/00

[52] U.S. Cl. ..... 34/12; 53/442; 53/557; 34/60; 34/225; 34/216; 34/217

[58] Field of Search ..... 34/12, 60, 22, 209, 34/210, 215-218, 225, 233, 236; 53/442, 557, 329

[56] References Cited

U.S. PATENT DOCUMENTS

| | | | |
|---|---|---|---|
| 4,676,006 | 6/1987 | Tolson | 34/233 |
| 4,738,082 | 4/1988 | Saitoh | 53/557 |
| 5,062,217 | 11/1991 | Tolson | 34/22 |

*Primary Examiner*—Henry A. Bennet
*Assistant Examiner*—Denise L. Gromada
*Attorney, Agent, or Firm*—Olive & Olive

[57] ABSTRACT

An apparatus and method is provided to shrink a heat shrinkable film wrapped around a product so as to produce a neat, wrinkle free finished package. As the product is transported along a conveyor path, first a bottom portion of the shrinkable film is shrunk by hot air; second, both side portions of the shrinkable film are shrunk by hot air; and third, the top portion of the shrinkable film is shrunk by warm water. The warm water employed is maintained at a temperature which is lower than that of the hot air so as to avoid wrinkles or damage to the film while efficiently shrinking the film.

16 Claims, 3 Drawing Sheets

APPARATUS AND METHOD FOR SEQUENTIAL SHRINKING OF PACKAGING FILM

FIELD OF THE INVENTION

The invention disclosed relates to apparatus and methods for shrinking heat shrinkable film wrapped around products packed in trays.

BACKGROUND OF THE INVENTION

Many products are packaged in trays which are overwrapped with a clear, plastic, heat shrinkable film. The clarity of the film adds to the market appeal and contributes to the ultimate success of the product sales. It is also important to obtain a wrapped package in which the plastic film is smooth in appearance, rather than wrinkled, so as to optimize the appeal of the product in the eyes of the customer. These basic concepts particularly apply to packages wrapped in heat shrinkable film.

In the process of wrapping and shrinking of film, it is common to seal the film between successive packages on a line crosswise of the conveyor direction of travel and to subsequently heat shrink the film into intimate, wrinkle-free contact with the product and the product-carrying tray. During ordinary film shrinking operations, a blast of heated air is directed at the wrapped product so as to shrink the film. Such a system using heated air to shrink a wrapping film is described in applicant's prior U.S. Pat. No. 5,062,217 for a Selective Sequential Shrinking Apparatus And Process. The teachings of U.S. Pat. No. 5,062,217 are incorporated herein by reference.

It has also been known to shrink heat shrinkable film by use of hot water. However, so far as applicant is aware, it has not been known to use both hot air and warm or hot water in a combination as in the invention.

The hot air method of the '217 patent represents a significant improvement over the prior art, but through practice has also been found to have limitations under certain circumstances. Particularly difficult circumstances are encountered in the shrinking of heat shrinkable film around a cold product such as, for example, tray-packaged poultry. In order for heat shrinkable film to shrink, it is necessary for the film to achieve a certain minimum temperature. It has been discovered that when the heated air impinges on the upper portion of the heat shrinkable film, the film is pressed downward into contact with the cold poultry product. The cold poultry, in these circumstances, tends to absorb a significant portion of the heat from the heated air and prevent the film from getting hot enough to shrink. Because of this heat absorbtion, the film frequently does not shrink in those sections of the film which are in contact with the cold poultry product but does shrink where not in such contact, creating a differential shrink situation and which produces undesired wrinkles.

If in order to overcome this undesired partial shrinkage, an attempt is made to increase the air temperature or the time during which the film is exposed to the heated air other problems have been found to occur. One such problem is that the added heat exposure may cause a hole to be burned through the portion of film which is not in contact with the cold poultry product thereby causing defective packaging. Another problem which occurs with regularity is that when the poultry comes in contact with either hot air for a greater than normal time or with hot air at an excessively high temperature, the poultry product begins to be cooked, which condition is also unacceptable.

A further difficulty frequently occurs as a result of heat shrinking the film with hot air in the fast-moving conveyor driven production equipment of today. Heat shrinkable film wrapped packages with their ends heat sealed may, for example, be fed from the wrapping machine to a shrinking machine at a processing speed of 40–50 pieces per minute. Immediately after sealing at this speed, the seam is quite warm and fairly weak. At this processing speed, it is also to be observed that there is only 1 or 2 seconds available for the sealed ends to cool and solidify before the beginning of the shrink process. The outcome is that, under certain conditions of speed, hot air heat and film, some of the end seals will rupture when subjected to the stress of heat shrinking.

Therefore, an objective of the present invention is to provide an apparatus and method for shrinking of heat shrinkable film wrapped and sealed around a product so as to avoid wrinkles.

An additional objective of the present invention is to provide an apparatus and method for shrinking of heat shrinkable film so as to prevent film burn-through or product cooking.

A further objective of the present invention is to provide an apparatus and method for shrinking of heat shrinkable film without rupturing of previously welded end seals.

These and other objectives will become apparent from the details of the disclosure which follows.

SUMMARY OF THE INVENTION

The invention disclosed herein provides an apparatus and method for efficiently shrinking wrapping film around a cold, tray-packed product utilizing a hot air shrinking medium on lower portions of the package and a warm liquid shrinking medium subsequently on the upper portion. By taking advantage of the recognized superior effectiveness of warm liquid-induced shrinkage, adequate shrinkage is achieved through a final warm water shrink step at a lower temperature than that possible with hot air. The hot air shrinking is directed to the lower portions of the film wrapped tray where the tray acts as an insulating layer, and the warm water shrinking is directed in a subsequent step to the upper portions of the film wrapped tray where the cold product might otherwise impede shrinkage. A further feature of the method and apparatus of the invention is that a cool air step takes place at the beginning of the process so as to solidify the welded end seal prior to subjecting it to the stress of the shrinking process. Other features of several embodiments of the invention include optional cool air flow before warm water shrinking and an optional drying step after warm water application.

DESCRIPTION OF THE PREFERRED EMBODIMENT

As previously mentioned, the prior apparatus and method as disclosed and taught in U.S. Pat. No. 5,062,217 has through practice, been found to have certain disadvantages when used under certain conditions. The present invention is directed to both eliminating such disadvantages and providing an improvement upon the teaching of the '217 patent. In particular, beyond the problems discussed, the present invention recognizes that liquids in general, and water in particular, transfer heat more efficiently than gases. Therefore, warm water can either warm an object to a given temperature more quickly than warm air, or warm water will heat an object in a similar time to that required for hotter air. By either using water at a lower temperature or for less time at a similar temperature to the temperature of heated air, the possibility of cooking the poultry product or of burning a hole through the wrapping film will be significantly reduced. In addition, while air can be heated to 177° C. (350° F.) or higher, water is effectively limited to a maximum temperature of about 100° C. (212° F.), its boiling point, so that the chance of an accident because of overheated water is much less.

Figure 1:
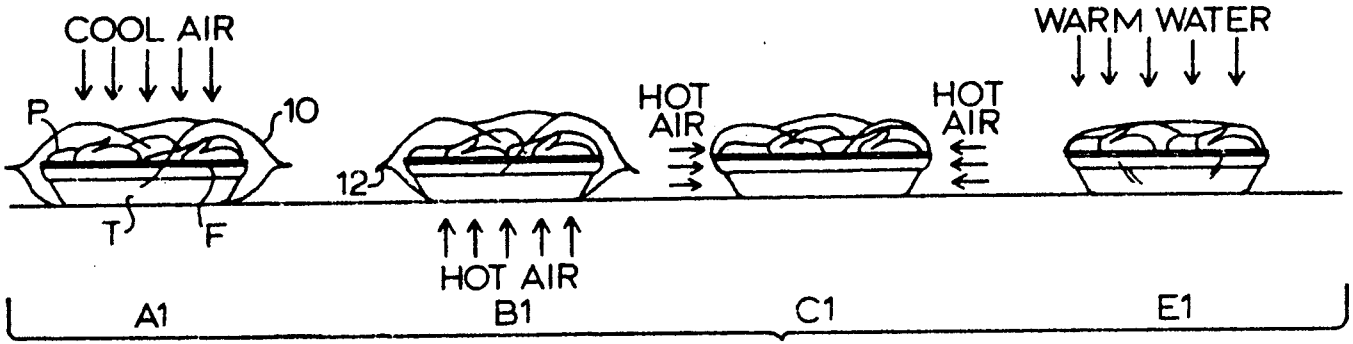
FIG. 1 is a diagrammatic representation of the minimal steps comprising the basic process of the invention.

Referring now to the drawings, it may be readily seen that the several variations on the basic method disclosed involve a number of steps, some of which may or may not be included in the process employed. The steps are identified by the letters A–F with a specific letter designating the same operative step in each figure, although not all figures have all steps included. In each figure, the steps used acquire the suffix of the number designating that figure. Thus, the first step in FIG. 1 is labeled Al. An explanation of each of the process steps follows to provide an understanding of the overall invention.

Figure 4:
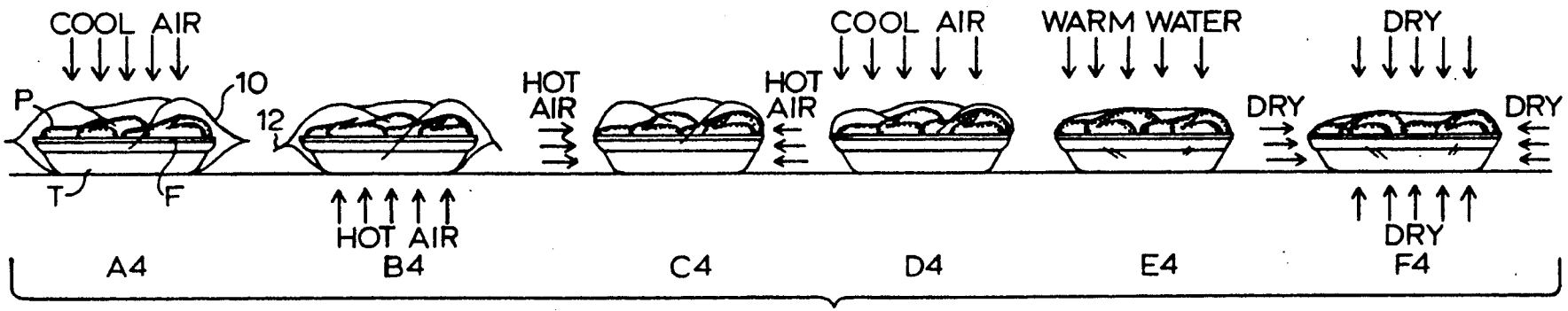
FIG. 4 is a diagrammatic representation of the steps comprising a version of the invention process incorporating the enhancements of both FIG. 2 and FIG. 3 above.

To understand the entire process including all the available steps, attention is directed first to FIG. 4. Step A in FIG. 4, otherwise designated as step A4, involves a downwardly directed flow of cool air to the top of the heat shrinkable film 10 wrapped product P, which process step is performed soon after crosswise sealing has been accomplished in a preceeding wrapping machine at each end of each tray T. The cool air temperature acts to improve the strength of the heat sealed end seams 12 and also to urge the extended end seams 12 of the wrapped package downwardly to assist in hiding end seams 12 beneath the flange F of the tray T.

Steps B4 and C4, though not in the combination of the invention, are essentially individually identical to the steps of bottom film and side film shrinking as disclosed in patent '217, and accomplish the same results. In step B4, hot air is directed at the bottom of film 10 to shrink the bottom film first and pull end seams 12 downwardly so as to tuck unobtrusively beneath peripheral protruding flanges F of tray T. In step C4 hot air is caused to be directed laterally at the lower sides of film 10 to shrink the lower side portions and apply tension to the upper portion of film 10 prior to shrinking the upper portion. Once the bottom and side film portions have been shrunk, a flow of cool air as in step D4 may be optionally included to reduce the temperature of the upper wrapping film, preparatory to shrinking the top film.

In step E4 of FIG. 4, the film wrapped around the tray T and the poultry product P is subjected to a warm water spray from above according to the invention. The warm water, at a temperature no hotter than the 100° C. (212° F.) boiling point of water, will transfer its heat to the film 10 rapidly and cause the film 10 to shrink without burning and will prevent cooking the poultry product P. Liquids other than warm water could be used for the step of shrinking the top of film 10 while retaining an advantageous heat transfer efficiency as compared to hot air. Warm water, however, is a logical choice for reasons of availability, cost and ease of clean up.

In a final process step F4, warm or cool air is moved at a high rate of speed across all sides of the package so as to drive off the water introduced by the water induced shrinking of step E4. As air velocity is a significant factor along with air temperature in the process of drying, the temperature and velocity of the drying air are determined by the requirements of the particular process involved.

Returning to the basic process illustrated in FIG. 1, it is seen that only four steps are involved. This sequence comprises the minimal basic needs of the invention. Step Al is the step of directing a downward cooling draft to solidify the heated end seams 12 and to wrap the end seams 12 down beneath the tray T flanges F prior to the step of shrinking the lower portions of the film wrap. Step B1 is the step of shrinking the lower portion of film 10 by utilizing hot air. Step Cl is the step of shrinking the lower side portions of the film 10 by utilizing hot air. Step El is the step which employs warm water to accomplish a shrinking of the top of the film 10 without danger of either burning the film or of cooking the poultry product P. While steps B1 and C1 have been known individually, they have not been known in the combination disclosed and claimed.

Figure 2:
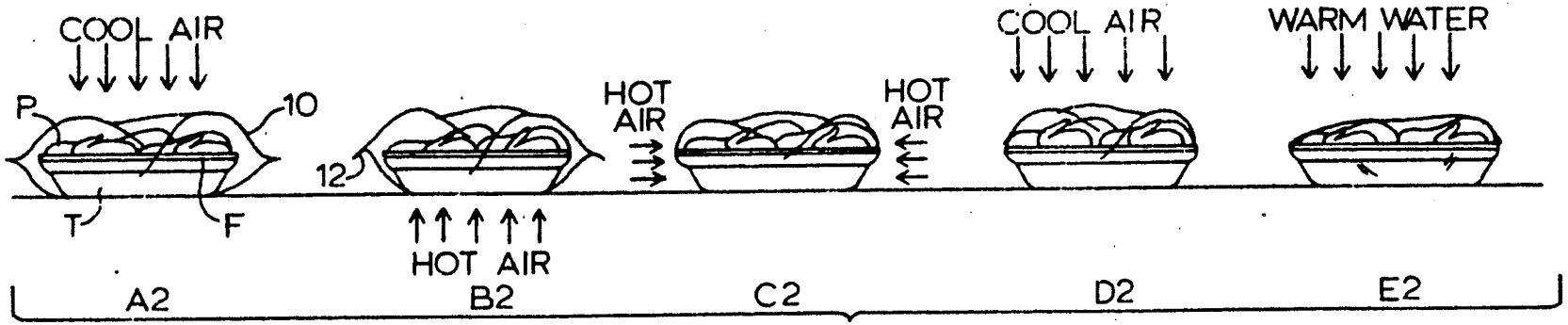
FIG. 2 is a diagrammatic representation of the steps comprising an enhanced version of the basic process of the invention having a cool air step before the final warm water shrinking.

In FIG. 2, five steps are included. The five steps include all steps of the process of FIG. 1 and the added step D2 of directing a stream of cool air onto the top of film 10 after the hot air shrinking associated with steps B2, C2 has occurred. Step D2 is optional, and offers the advantage of cooling the upper film after exposure to the hot air environment so as to further ensure the integrity of the top of film 10 through top shrinking step E2. The warm water associated with step E2 acts to shrink the top portion of the film as described above.

Figure 3:
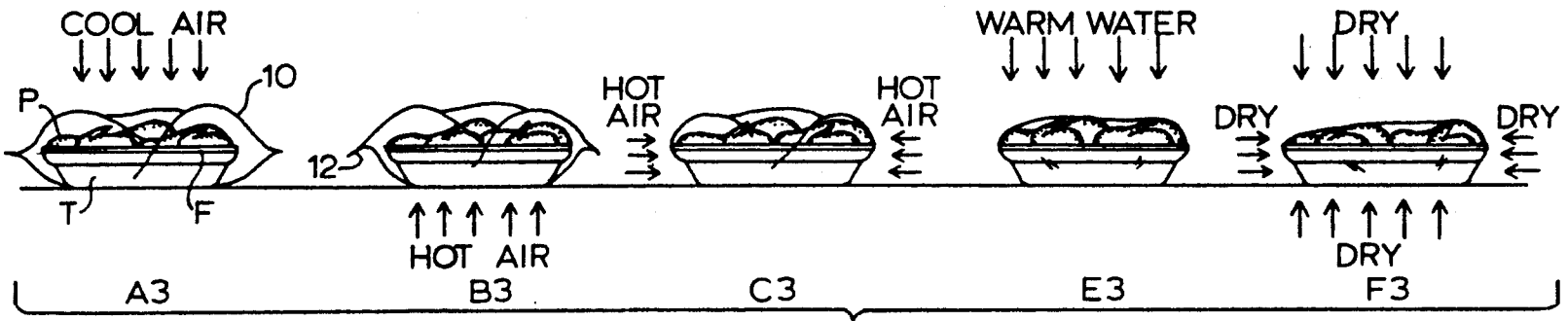
FIG. 3 is a diagrammatic representation of the steps comprising a version of the invention process enhanced in a different way than that of FIG. 2 by having a final drying step after the warm water shrinking step.

FIG. 3 is also representative of a five-step process, and includes steps A3, B2, C3 and E3 which are similar to the steps discussed above. The process of FIG. 3 does not include the step D for cooling the top of film 10, but proceeds directly to step E3 to shrink by warm water. Subsequent to the warm water shrinking, a step F3 is used to dry the wrapped package of residual water. While step F3 is somewhat optional, it does allow an increase in the speed of processing in most cases. Dry air, heated or unheated, may be directed at the wrapped package from any combination of the six sides of the package as desired by the user.

Figure 5:
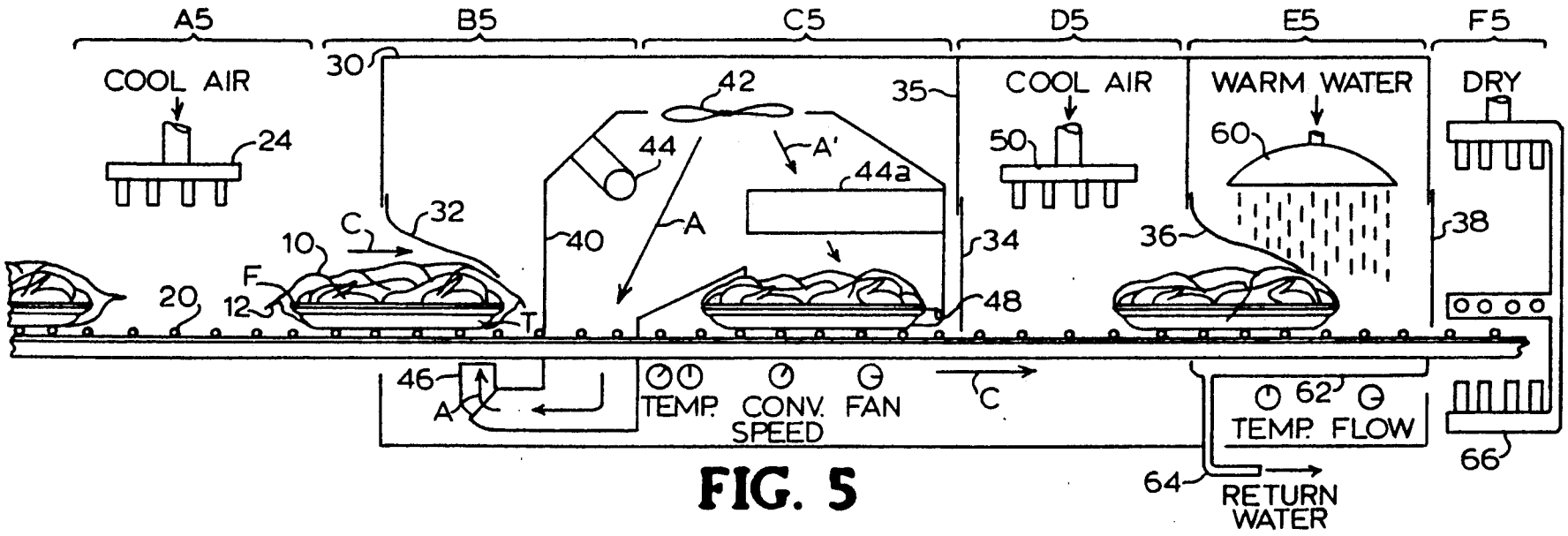
FIG. 5 is a schematic drawing of the apparatus of the invention illustrating the various operating stations employed in the process described diagrammatically in FIGS. 1–4.

Having described the available combinations of four standard and two optional steps of the process of the invention, as illustrated diagrammatically in FIGS. 1–4, the following description discloses the apparatus of the preferred embodiment as shown in FIG. 5. The apparatus portrayed in FIG. 5 is an improvement on the apparatus of patent '217 as best seen by reference to the process steps described above. Each of the operative sections in the apparatus of FIG. 5 is identified by letters relating to the several steps of the processes above.

The preferred embodiment portrayed in FIG. 5 comprises a heat shrink tunnel 30 through which product conveyor 20 carries trays T filled with product P in a continuous stream. Product P in each tray T is moved in the direction indicated by arrow C such that it passes stations A5, B5, C5, D5, E5 and F5 in sequence, though not all of the stations are necessarily operative.

At station A5, cool air nozzle 24 directs a stream of cool air at the upper surface of film 10 and end seams 12 as each tray T passes therebelow. Flexible curtain 32 hangs limply downward to close the entry to shrink tunnel 30 between successive trays T. Each tray T moves forward on conveyor 20 and contacts and forces curtain 32 open. As each tray T is moved farther by conveyor 20 over the top of upwardly facing hot air nozzle 46, hot air is directed at the bottom of film 10 to shrink the bottom first and pull the sides down, particularly in the area of end seams 12 so as to cause the end seams 12 to be hidden beneath tray flanges F. The hot air stream conveyed by nozzle 46 in station B5 is indicated as arrows A and is pushed by fan 42 past heating element 44, all contained within plenum 40. Air from fan 42 is also pushed past heating element 44*a* in station C5, designated as air stream arrow A', and is used to pass through hot air nozzle 48 which directs the hot air at laterally opposed lower sides of each film 10 wrapped tray T to complete shrinking of the lower area thereof.

Each tray T next passes flexible curtain 34 which acts to segregate the hot air portion of shrink tunnel 30. On the exit side of curtain 34, each tray T enters station D5 where cool air is blown down at the top of film 10 from cool air nozzle 50. This flow of cool air serves to reduce the temperature of the upper surface of film 10 prior to final shrinking so as to better ensure that added heat will not damage film 10.

Each tray T then enters station E5 by passing flexible curtain 36. In station E5, film 10 is subjected to a warm water shower from nozzle 60 to shrink the upper portion thereof more gently and effectively, in terms of the temperature required to shrink. The water flowing off each tray T is caught by drip pan 62 and returned via return piping 64 to the heating and pumping apparatus (not shown) to be reused. Each tray T finally exits shrink tunnel 30 through flexible curtain 38 to emerge into station F5 where a warm air draft is directed at multiple sides of the tray T to drive off the residual water. As described above, the drying air may be warmed or cool depending on the requirements of the operation.

A set of controls, as are conventionally known, are provided to regulate the various functions of the equipment. As shown schematically in FIG. 5, there is a control for the speed of the conveyor and a temperature control for each of the hot air and hot water stations and a control for the air driving fan. There are separate controls for the temperature of the warm water and for the amount of water flowing per unit time.

In summary, the apparatus and method of the present invention satisfies the objectives by providing means to shrink differentially a heat shrinkable film wrapped around a product in a tray by first applying cool air to the top of the film, next applying hot air to the bottom and then the sides of the film and then applying cool air to the top of the film again. In a final shrink step, warm water is applied to the top of the film and the film is then dried of residual water. Certain of the operating stations of the apparatus may be optionally used or not depending on the requirements of the process such as film type and thickness, product type and temperature, operating speed, and others. However, in all embodiments at least those steps depicted in FIG. 1 will be utilized in order to accomplish the desired differential shrinking effect of the invention. In a typical application, the type heat shrinkable film used is made of polyvinylchloride (PVC). The temperature of the cool air typically ranges between 4°-24° C. (40°-80° F.); the temperature of the hot air ranges between 94°-230° C. (208°-450° F.); and the temperature of the warm water ranges between 70°-99° C. (160°-210° F.).

The above disclosure described the preferred embodiment which, as will be understood by those skilled in the art, may be practiced in a number of ways considered to be within the scope and principles of the invention.

What is claimed is:

1. An apparatus for shrinking of a heat shrinkable wrapping film wrapped around a package comprising a tray and a contained product, said apparatus comprising:

(a) conveyor means adapted to sequentially transport a plurality of packages wrapped in said wrapping film along a path extending between an entry point and an exit point and through a series of operating stations;

(b) a first station positioned along the path of said conveyor having means to apply a stream of hot air to one or more surfaces of said wrapped film so as to shrink the film on said surfaces; and (c) a second station positioned along the path of said conveyor beyond said first station and having means to apply a stream of warm liquid to one or more surfaces of said wrapped film other than those to which hot air has been applied.

2. The apparatus as claimed in claim 1 in which said warm liquid comprises warm water.

3. The apparatus as claimed in claim 2 in which said first station comprises a pair of sub-stations each being adapted to apply hot air to a different one or more surfaces of said film.

4. An apparatus for differential shrinking of a heat shrinkable film wrapped around a package, comprising:

(a) a conveyor adapted to sequentially transport a series of packages wrapped in said heat shrinkable film from an entry point to an exit point and through a number of sequential operative stations therebetween;

(b) a first station positioned along said conveyor and including means operative to direct a stream of hot air at a lower portion of said film wrapped around said package;

(c) a second station positioned beyond said first station along said conveyor and including means operative to direct a stream of hot air at a side portion of said film wrapped around said package; and (d) a third station positioned beyond said second station along said conveyor and including means operative to direct a stream of warm liquid to an upper portion of said film wrapped around said package.

5. The apparatus of claim 4 further comprising an operative station positioned along said conveyor before said first station and having means to direct a stream of cool air at an upper portion of said film wrapped package.

6. The apparatus of claim 4 further comprising an operative station positioned along said conveyor beyond said second station and before said third station and having means to direct a stream of cool air at an upper portion of said film wrapped package.

7. The apparatus of claim 4 further comprising an operative station positioned along said conveyor beyond said third station and having means to dry said warm liquid from said film.

8. The apparatus of claim 5 further comprising an operative station positioned along said conveyor beyond said second station and before said third station and having means to direct a stream of cool air at an upper portion of said film wrapped package.

9. The apparatus of claim 5 further comprising an operative station positioned along said conveyor beyond said third station and having means to dry said warm liquid from said film.

10. A method of shrinking a heat shrinkable film wrapped around a package, comprising:

(a) transporting a series of said film wrapped packages by a conveyor means through a series of operative stations;

(b) directing a stream of hot air at one or more surfaces of said film on said package; and (c) directing a stream of warm liquid at one or more surfaces other than those to which said hot air was directed.

11. The method as claimed in claim 10 further comprising directing a stream of cool air at an upper surface of said film wrapped package before directing said hot air at said film.

12. The method as claimed in claim 10 further comprising directing a stream of cool air at an upper surface of said film wrapped package after directing said hot air and before directing said warm liquid.

13. The method as claimed in claim 10 further comprising directing drying air at plural sides of said film wrapped package after directing said stream of warm liquid.

14. The method as claimed in claim 11 further comprising directing a stream of cool air at an upper surface of said film wrapped package after directing said hot air and before directing said warm liquid.

15. The method as claimed in claim 11 further comprising directing drying air at plural sides of said film wrapped package after directing said stream of warm liquid.

16. The method as claimed in claim 12 further comprising directing drying air at plural sides of said film wrapped package after directing said stream of warm liquid.

* * * * *